US005351905A

United States Patent [19]

Ferber

[11] Patent Number: 5,351,905

[45] Date of Patent: Oct. 4, 1994

[54] COHESIVE STRETCH-TAPE WRAPPER WITH POSITIVE-BRAKING ACTION

[76] Inventor: Norman I. Ferber, 17 Owens Rd., Marlboro, N.J. 07746

[21] Appl. No.: 604,162

[22] Filed: Oct. 29, 1990

Related U.S. Application Data

[63] Continuation-in-part of Ser. No. 185,697, Apr. 25, 1988, abandoned.

[51] Int. Cl.[5] ..... B65H 23/06

[52] U.S. Cl. ..... 242/588.2; 242/596.7; 242/597.5

[58] Field of Search ..... 242/96, 99

[56] References Cited

U.S. PATENT DOCUMENTS

| | | | |
|---|---|---|---|
| 4,172,567 | 10/1979 | Post . | |
| 4,179,081 | 12/1979 | Parry | 242/96 X |
| 4,248,392 | 2/1981 | Parry | 242/96 |
| 4,285,477 | 8/1981 | Oxendahl et al. | 242/96 |
| 4,372,500 | 2/1983 | Saraisky | 242/96 X |
| 4,477,037 | 10/1984 | Goldstein | 242/96 X |
| 4,484,717 | 11/1984 | Goldstein | 242/99 X |
| 4,530,473 | 7/1985 | Parry | 242/96 X |
| 4,535,951 | 8/1985 | Riemensehneider, III | 242/96 X |
| 4,575,020 | 3/1986 | Strout et al. | 242/96 X |
| 4,600,163 | 7/1986 | Hummell et al. | 242/96 |
| 4,714,211 | 12/1987 | Hwang | 242/96 |
| 4,752,045 | 6/1988 | Goldstein | 242/96 X |
| 4,784,348 | 11/1988 | McDonald | 242/96 |
| 4,817,762 | 4/1989 | Powell | 242/96 X |
| 4,834,312 | 5/1989 | Riemenschneider, III | 242/96 |
| 4,852,822 | 8/1989 | Brady | 242/96 |
| 4,872,623 | 10/1989 | Parry et al. | 242/96 |
| 4,917,041 | 4/1990 | Weiswurm et al. | 242/96 X |
| 4,989,803 | 2/1991 | Lambert et al. | 242/96 |
| 5,024,401 | 6/1991 | Nakashima | 242/96 X |

FOREIGN PATENT DOCUMENTS

| | | | |
|---|---|---|---|
| 2065070 | 6/1981 | United Kingdom | 242/96 |
| 212001 | 12/1983 | United Kingdom | 242/96 |

*Primary Examiner*—Daniel P. Stodola
*Assistant Examiner*—John P. Darling
*Attorney, Agent, or Firm*—Charles I. Brodsky

[57] ABSTRACT

The wrapper includes a roll of stretch-tape on a central core, in its basic form, with a single end extension. A cap is secured at the remote end of the extension, and an incompressible sheath encircles the extension to freely rotate when the wrapper is used with tape being drawn from off the roll. The cap is dimensioned to prevent the sheath from separating from the extension, and is grasped by the heel of the hand of the user to prevent rotation of the extension when the tape is stretched, to be broken from the roll. Because the cap is of greater dimension than the sheath, the wrapper can be hand-held and operated at any angle as the circumstances of use dictate.

In a second version, a pair of end extensions can be employed, making the use two-handed instead of one-handed, with the same type of braking action being provided by the caps being grasped by the heels of the hands of the user at either end preventing rotation of the stretch-tape roll.

6 Claims, 2 Drawing Sheets

FIG. 1A
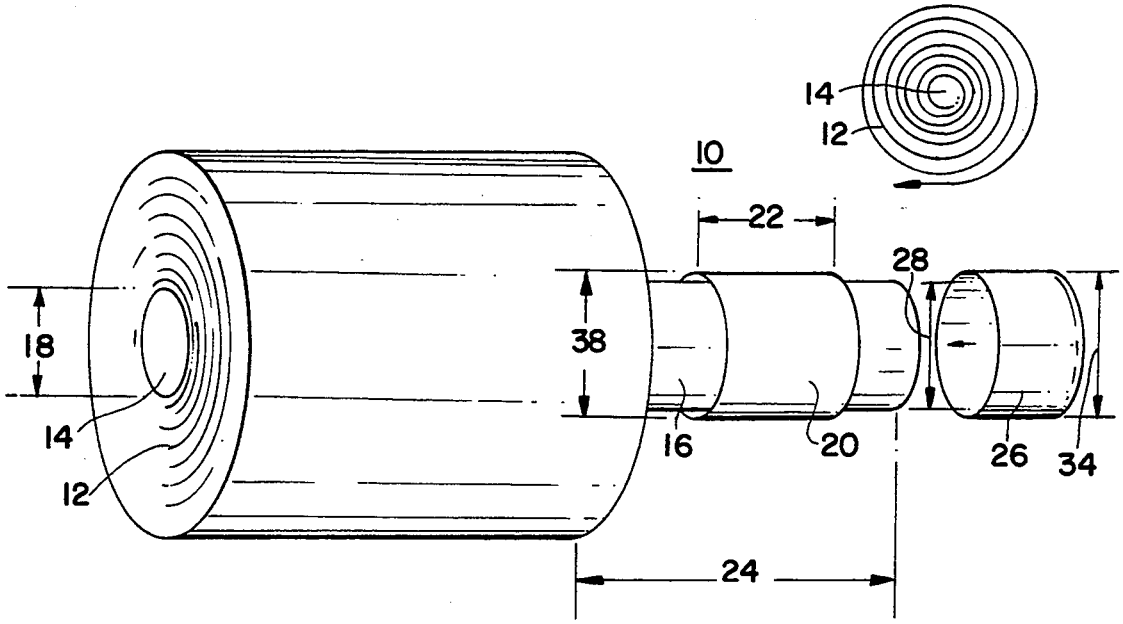
FIG. 1
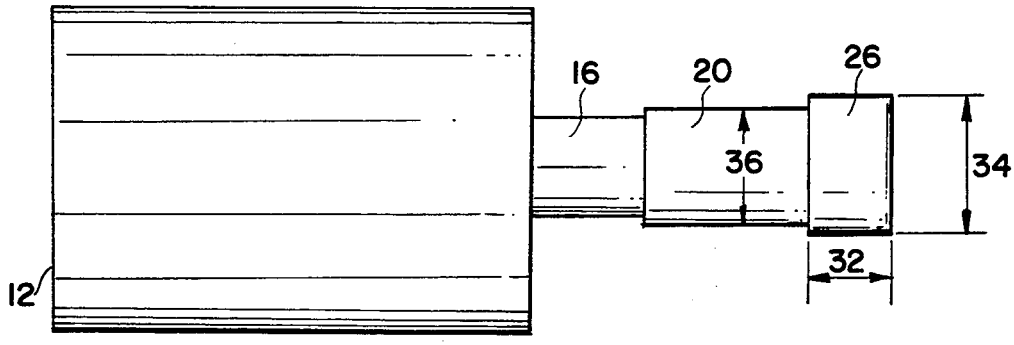
FIG. 2
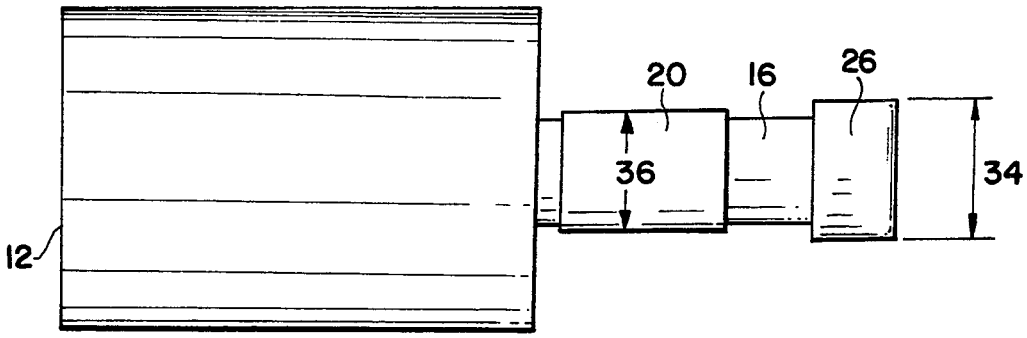
FIG. 3

COHESIVE STRETCH-TAPE WRAPPER WITH POSITIVE-BRAKING ACTION

This Application is a Continuation-in-Part of Application Ser. No. 07/185,697, filed Apr. 25, 1988, now abandoned.

FIELD OF THE INVENTION

This invention relates to stretch-tape wrapping, in general, and to a self-contained, hand-held device having the ability to apply a positive braking tension to the stretch-tape when in use, in particular.

BACKGROUND OF THE INVENTION

As is well known and understood, stretch-tape is a fairly recent product development to be employed in the bundling of various packages to be shipped. As its name implies, the tape is stretched around such products, in an attempt to hold them securely in place. Along with the advent of stretch-tape have been suggestions as to the manners in which such a development can be used. Arrangements available have, for certain applications, required the use of two hands for performing an operation, while other suggestions have related to a single-hand usage. However, there has been found to be a need for a simple device, easily constructed and operated, inexpensive to manufacture, and which still continues to provide all the advantages of stretch-taping no matter at what angle the hand-held device is being utilized at. As will be readily appreciated, when the apparatus is being utilized in the wrapping of complex articles—e.g. furniture, lumber, cartons, pipes, drawers, etc.—it becomes necessary to effectuate the securement whether the device is being held upright, downwardly, horizontally, or at any angle inbetween. A self-contained unit, with a built-in dispenser that can do all of this, would prove greatly advantageous.

Additionally, it would be advantageous if a design were made available which would operate in context where both single-handed, and two-handed operations could be had with the same type construction. This, of course, extends the range of use of a stretch-tape wrapping device—especially, if a second such unit need not have to be purchased.

And, of obvious importance, is the need for a wrapper that affords a reliable braking action in insuring that the tape will be stretched, to be broken from off-the-roll when the articles being wrapped have been tied to satisfaction.

SUMMARY OF THE INVENTION

As will become clear hereinafter, a preferred embodiment of the wrapper device of the invention includes a roll of stretch-tape on a central core provided with a single end extension. An incompressible sheath encircles the extension so as to permit the free rotation of the core when the user holds the extension in drawing the stretch-tape from off the roll. With the sheath being incompressible, the user merely holds onto the sheath as the core extension rotates, thereby avoiding any friction being produced of an irritating nature to the user. As will be seen, the wrapper device also includes a cap at the end of the extension, snugly secured to the extension, and of diameter size greater than that of the incompressible sheath, so as to prevent the sheath from separating from the core extension no matter what angle the wrapper is being hand-held at. In particular, the cap will be noted to have an inner diameter, in a preferred embodiment, just slightly larger than the outer diameter of the core so as to form a snug fit between the two, and with the cap having an outer diameter greater than the outer diameter of the incompressible sheath. In such manner, the sheath will be seen to be prevented from riding out and off the extension as the core and roll rotate together when drawing off the tape in any kind of wrapping or bundling operation. To break the tape from the roll (when the wrap has been completed), simple pressure of the heel of the hand on the cap restricts any further rotation of the core and roll, thereby permitting the stretching of the tape—and, a reliable braking action results from preventing the core and roll rotation.

As will also become clear hereinafter, the wrapper of the invention (in a second embodiment) can incorporate a second core extention on the other side of the roll, having its own incompressible sheath and cap, for use where a two-hand held construction is required. As will be appreciated by those skilled in the art, one-hand operation is desirable for the wrapping and bundling of certain kinds of material but, historically, other types of articles have been wrapped with an apparatus held in two hands. In the second embodiment of the invention, as will be noted, the tendency for the sheath to come off during a wrapping operation is by-and-large not really a problem, but the positive braking action afforded by grasping with the heel of the hand the snugly-fitted cap on the extension end proves quite attractive in easily stopping the rotation of the roll, and in the consequent stretching and breaking the tape when the wrap is completed.

In a similar manner, the features of the invention will also be apparent in a third embodiment, wherein a separate dispenser can be employed for fitting into a core of a separate stretch-tape roll, with the incompressible sheath and end cap continuing to afford the advantages of friction-free rotation while the device permits unwrapping of the tape when being held, and the positive braking when it is desired to stretch the tape for tightening the wrap, and ultimately breaking the tape from the roll, by grasping the end cap with the heel of the hand. The functions provided will thus be seen to continue, but with a dispenser sold or distributed separate from a roll of stretch-tape with which it is intended for use. Once the dispenser is inserted into the separately supplied roll of tape, however, the friction-free action of the incompressible sheath, and positive braking of the cap will be seen to follow—both, in versions where only a single dispenser is inserted in the stretch-tape roll (for one-hand operation) as well as where a pair of dispensers are secured to the stretch-tape roll (for two-handed use).

BRIEF DESCRIPTION OF THE DRAWINGS

These and other features of the invention will be more clearly understood from a consideration of the following description, taken in connection with the accompanying drawings, in which:

FIG. 1 shows the wrapper of the invention, in a preferred embodiment for one-handed operation, as it would appear prior to final construction;

FIG. 1A illustrates the drawing of tape from off the roll of FIG. 1;

FIGS. 2–3 schematically illustrate the operation of the wrapper of FIG. 1 when drawing stretch-tape from off the roll and in its stretching (and breaking) respectively;

DETAILED DESCRIPTION OF THE DRAWINGS

Figure 4:
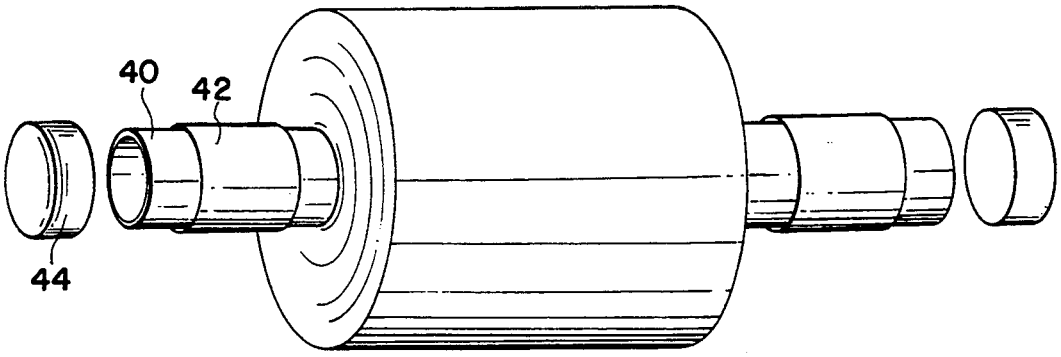
FIG. 4 shows the wrapper of the invention, in a preferred embodiment for two-hand usage, as it would appear in final construction.

Referring to FIGS. 1-3, the wrapper of the invention for one-handed use is indicated by the reference numeral 10, having a roll of stretch-tape 12 on a central core 14 having a single end extension 16. As indicated in the FIG. 1A insert alongside FIG. 1, the stretch-tape 12 comes off when rotating the roll in a clockwise direction, with the core 14 having an outer diameter indicated at 18.

Encircling the core extension 16 is an incompressible sheath 20, which has a length 22 less than the length 24 of the extension 16—and which, in one embodiment of the invention, was constructed of a hard cardboard material. As will be readily apparent, the inner diameter of the incompressible sheath 20 would be somewhat greater than the outer diameter 18 of the core 14, so as to permit the free rotation of the core 14 and roll 12 when the stretch-tape is being drawn from off the roll. In operation, the user merely holds onto the sheath 20 as the stretch-tape is being drawing off, with the core extension 16 rotating within the surrounding incompressible sheath 20.

Also shown is a cap 26 having an inner diameter 28 which is just slightly greater than the outer diameter of the core extension 16 so as to snugly fit thereover in being held in place at the end of the extension 16. Shown as being of a length 32, the cap 26 also is dimensioned to have an outer diameter 34 which is greater than the outer diameter 36 of the incompressible sheath 20, whose inner diameter is shown by the reference numeral 38. With such dimensionings, it will be readily apparent that the sheath 20, although able to freely permit the core extension 16 to rotate within it, is prevented from separating from the core extension 16, and by virtue of the larger diameter roll 12 and cap 26 at its opposite ends.

When it is desired to bundle a package (e.g. wrapping a pallet, strips of lumber, series of cartons, drawers of desk to be shipped, etc.), the user grasps the incompressible sheath 20 and cap 26 simultaneously in one hand (it being understood that the length 24 of the core extension 16 being selected together with the length 22 of the sheath 20 as to insure such happening), and the withdrawing of the stretch-tape from off the roll 12 will be seen to be in such a direction as to cause the sheath 20 to ride along the extension 16 towards the end where the cap 26 is positioned, adjacent to the heel of the user's hand. While this presents no problem in the instances where the wrapper is being held generally upright (or at an upward angle), the situation would otherwise become quite different at downward angles if the cap 26 were not in place—as, in those instances, there would be nothing that would be holding the sheath 20 in position in preventing it from coming off the extension 16. In other words, even though the sheath 20 is being held by the user, the rotation produced as the extension 16 freely rotates within the sheath 20 during the tape removal process will be in such a direction as to cause the device to come apart, with the roll of tape 12 then falling to the floor. In accordance with the invention, this is prevented, however, and by virtue of having the outer diameter 34 of the cap 26 greater than the outer diameter 36 of the sheath 20 (FIG. 2). The wrapper device will thus continue to operate unaffected, in permitting the bundling of complex articles, at whatever angle the user selects to orient the wrapper for convenience of handling.

As will be readily apparent, when the sequence of the bundling operation becomes such where the tape is to be stretched (or where the tape is to be stretched to an extent to be broken off), the user just compresses the cap 26 with the heel of the hand, while continuing to go around the article to be secured, but at such instance, the core 14 and the extension 16 cannot rotate (because of the compression applied by the heel of the hand of the user to the cap 26 which is in snug fit with the core extension 16), and the tape thus gets stretched, eventually to the point where it will eventually be broken off. Such instance is more clearly shown in FIG. 3, where the sheath 20 stays along the length of the extension 16.

The end result will thus very simply be seen to be one in which the wrapper can be hand-held, in one hand, as a self-contained unit including the dispenser, the core, the sheath which permits the core to rotate allowing the stretch-tape to be withdrawn, and the cap end which prevents the sheath from coming off no matter what angle the device is being hand-held at. The wrapper can thus be utilized at any desired angle of orientation consistent with the desired wrapping of products to be shipped, enabling a one hand-held operation to girth pallets, bundle cartons and pipes, bundle lumber and carpeting, securing drums and hand-truck loads, holding drawers and doors closed, bundling papers and envelopes—and a tremendously wide variety of applications where heretofore great difficulty was encountered when the user would attempt to wrap these units secure from a bending-over position, or using the previously available two-handed wrapping arrangements. The hand-held operation at any angle of use, has been determined to be quite advantageous, and continues to be tremendously efficient, and to the extent that even small children can operate the apparatus. Along with its being altogether constructed as a self-contained unit with its own built-in dispenser, the wrapper of the invention as thus described can be quite inexpensive to manufacture and sell. Ease of operation has been found to be not only exceedingly simple, but also exceedingly fast in handling.

Equally advantageous, furthermore, is the absence of friction being produced on the hand of the user as he unwraps the stretch-tape from off its roll. In particular, all the user need do is to grasp the incompressible sheath 20, whose greater inner diameter permits the core extension 16 to freely rotate as the tape is being drawn off the roll, and with such free-rotation of the extend 16 being prevented from translating to the hand of the user by the presence of the sheath 20. This will be seen to be all the more important in those instances where a great amount of wrapping has to be done, where otherwise a recurring friction from rotation can prove quite irritating to the user's hand.

Use has further shown that the combination of the cap 26, snugly fit around the core extension 16, provides a very reliable braking action when it is desired to stretch the tape and break it off, as the pressure of the heel of the hand on the cap 26 prevents any continued rotation of the core extension 16 and the roll 12. In effectuating this, all that is necessary (besides providing the required fit between the cap 26 and core extend 16 so that the pressure on the cap 26 will prevent the continued rotation of the core extension 16), is to dimension the cap length 32, the length 24 of the core extend 16 and the length of the sheath 22 so that the user's hand will be able to simultaneously span the sheath 20 and an appreciable portion of the cap 26 at the same time. To stretch the film and break it off, in this manner, the user merely tightens up the heel of his, or her, hand about the cap 26 so as to brake further rotation of the core extend 16.

As previously mentioned, one of the features of the present invention is that the wrapper device can also be easily employed for two handed usage. Thus, in FIG. 4, there is shown the construction of FIG. 1, but with a second core extension 40, a surrounding incompressible sheath 42 and a snugly fitting cap 44 at the end of the extension 40, all three of which will be understood to have corresponding lengths, inner diameters and outer diameters as their corresponding counterparts 16, 20 and 26 of FIGS. 1–3 so as to be simultaneously held in the user's hands. Here, when it is desired to stretch the tape, pressures from the heels of both hands of the users will be applied at the caps 26, 44 so as to prevent further core rotation, and to produce stretching of the tape in a reliable braking manner.

As will be apparent to those skilled in the art, not all rolls of stretch-tape come with their own core 14 and core extension 16 (or 40, as the case may be). Many suppliers of stretch-tape provide rolls which are designed to accept a dispenser having a section which press-fits into an inner core of the roll. In accordance with the teachings of the present invention, such a roll, shown by reference numeral 50 in FIGS. 5 and 6, can be utilized with the dispenser 52 there shown and still exhibit the advantages previously described. Thus, the dispenser 52 is provided with its own extension 54, its surrounding sheath 56 and its cap 58 at the end of the extension 54—all relatively dimensioned as with respect to the wrapper of FIGS. 1–4 so as to be simultaneously held—, and with a hub 60 configured, and of appropriate dimension, to press fit within the core 62 of the stretch-tape roll 50. As will be readily apparent, operation continues as with the wrapper of FIGS. 1–4—the incompressible sheath 56 being of a diameter to permit the free rotation of the extension 54 and the roll 50 without producing friction on the user's hand, and the pressure eventually produced by the heel of the hand on the cap 58 being transmittable to stretch the tape coming off the roll 50, to the point of breaking it off the roll when the wrapping is completed. As before, the lengths selected for the extension 54, the incompressible sheath 56, and the cap 58 are to be such as to permit the span of the user's hand to encircle both the sheath 56 and at least a portion of the cap 58 during the times that the dispenser and roll are in use in wrapping the article of concern, and at any angle—be it upwardly, downwardly, horizontally, or at any angle inbetween.

Figure 5:
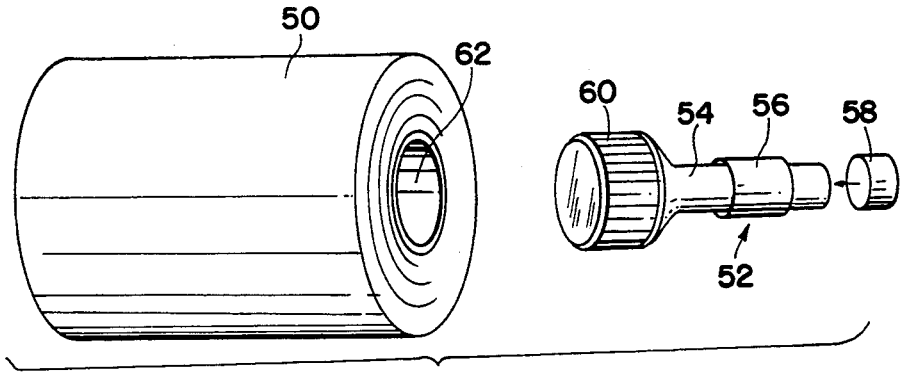
FIG. 5 shows a hand-held dispenser, according to the invention, for use with a different type of stretch-tape roll, embodying the frictionless and reliable braking aspects of the invention.
Figure 6:
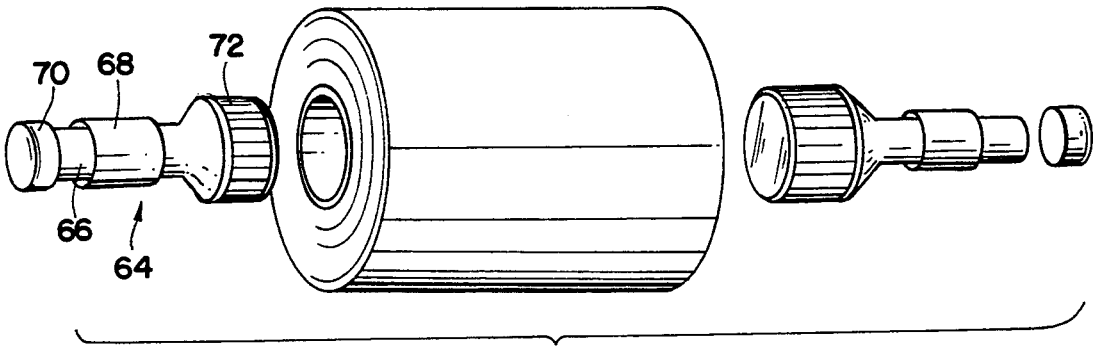
FIG. 6 illustrates the operation of the dispenser of FIG. 5, used in a two-hand manner for stretching tape from off the roll and in its stretching and breaking.

And, as will be readily understood, just as the wrapper of FIGS. 1–3 could be used for two hand usage (as in FIG. 4), so can the dispenser 52 of FIG. 5 be employed in a two hand operation with a roll of stretch-tape 50 having a thru-core 62, in which event the second dispenser 64 is shown with its own extension 66, its surrounding incompressible sheath 68 and its end cap 70 for transmitting the heel-of-the-hand pressure needed to stop the continued rotation of the roll 50 when it is desired to break off the tape from the roll 50.

Whereas there have been described what are considered to be preferred embodiments of the present invention, it will be appreciated that modifications can be made by those skilled in the art without departing from the scope of the teachings herein. Such modifications are to be considered within the context of the present invention where an incompressible sheath is held by the user and the core extends freely permitted to rotate within in a manner that does not transmit any friction to the user's hand, and where the pressure of the heel of the hand on the end cap prevents further rotation of the core in permitting the stretch-tape to come off the roll. Obviously, different configurations can be employed for the "end-cap", and different dimensionings can be employed for the component parts than are illustratively shown in the drawings, and still carry through on the manners in which the wrapper operates as herein described. Additionally, it will be readily apparent that while the stretch-tape roll has generally been described as having a width equal to, or less than the length of the co-linear core extension, strictly speaking this is only for the situation where one-handed use is intended—for two-handed usage, the width selected could be of dimension greater than the length of either core extension, or of either of the two extensions combined. Also, while the invention has been described in the context of having the outer diameter of the caps employed greater than the outer diameter of the sheath used—so as to prevent the sheath from coming off the core extension—the invention will operate equally as well where the sheath has an outer diameter greater than that of the cap, the wall thickness of the sheath there bearing up against the cap to again prevent its dislodgement; both such instances are to be understood as falling within the purview of terminology describing the "outer diameter of the cap being greater than the outer diameter of the sheath", so as to restrict an ability for the sheath to come off the co-linear extension at downward angles of use of the wrapper. For at least such reasons, resort should be had to the claims appended hereto for a true understanding of the scope of the invention.

I claim:

1. A stretch-tape wrapper comprising:

a roll of stretch-tape on a central core and rotatable therewith;

a co-linear extension coupling with said core only at one end thereof;

an incompressible sheath surrounding said co-linear extension along a portion of its length; and means situated at said end of said co-linear extension remote from said roll of stretch-tape for preventing separation of said incompressible sheath from surrounding said co-linear extension during periods of use of said stretch-tape wrapper at all extending angles of use;

wherein said roll of stretch-tape is located along said central core at an end thereof remote from said co-linear extension;

wherein said incompressible sheath is open at the opposite ends thereof and of a length less than the length of said co-linear extension;

wherein the inner diameter of said incompressible sheath is greater than the outer diameter of said co-linear extension in permitting the free rotation of said co-linear extension within said sheath when said wrapper is in use;

wherein said means includes a cap at said end of said co-linear extension having an inner diameter just slightly larger than the outer diameter of said co-linear extension to form a snug-fit therebetween and an outer diameter larger than the outer diameter of said incompressible sheath;

and wherein the lengths of said co-linear extension, said incompressible sheath and said cap are selected to permit a user to grasp with one hand both said incompressible sheath and said cap at the same time, with the heel of the hand grasping said cap;

whereby said incompressible sheath is captured in movement along said co-linear extension from said roll of stretch-tape to said cap in all angles of use of said wrapper, in unrolling said stretch-tape from said roll when not imparting pressure to said cap by the heel of the user's hand, and in breaking said stretch-tape from said roll when imparting pressure to said cap by the heel of the user's hand.

2. The wrapper of claim 1 wherein said roll of stretch-tape is of a width equal to, or less than, the length of said co-linear extension.

3. The wrapper of claim 1 wherein said co-linear extension is provided as an integral part of said core on said roll of stretch-tape.

4. The wrapper of claim 1 wherein said co-linear extension is provided as part of a separate dispenser arranged to couple within said core of said roll of stretch-tape.

5. The wrapper of claim 1 wherein said roll of stretch-tape is of a width greater than the length of said co-linear extention.

6. A stretch-tape wrapper comprising:

a roll of stretch-tape on a central core;

a co-linear extension of length $L_1$ coupling with said core, and having an outer diameter $D_1$;

an incompressible sheath on said co-linear extension, having a length $L_2$, an inner diameter $D_2$ greater than the outer diameter $D_1$ of said co-linear extension, and having an outer diameter $D_3$;

a cap on said co-linear extension at an end remote from said roll of stretch-tape, having a length $L_3$, an inner diameter $D_4$ slightly larger than the outer diameter $D_1$ of said co-linear extension so as to provide a snug-fit therebetween and an outer diameter $D_5$ larger than the outer diameter $D_3$ of said incompressible sheath;

wherein the co-linear extension length $L_1$ is greater than the sum of the incompressible sheath length $L_2$ and the cap length $L_3$ taken together; and wherein the co-linear extension length $L_1$ is selected to permit a user to grasp both of said incompressible sheath and said cap at the same time with one hand, with the heel of the hand grasping said cap.

* * * * *